US006213038B1

(12) United States Patent
Sahl

(10) Patent No.: US 6,213,038 B1
(45) Date of Patent: Apr. 10, 2001

(54) NEEDLE PLATE FOR A TWO NEEDLE INTERLOCK SEWING MACHINE

(76) Inventor: Johannes Sahl, Tannenweg 17, A-4501 Neuhofen/Krems (AU)

( * ) Notice: Subject to any disclaimer, the term of this patent is extended or adjusted under 35 U.S.C. 154(b) by 0 days.

(21) Appl. No.: 09/500,320

(22) Filed: Feb. 8, 2000

(30) Foreign Application Priority Data

Dec. 1, 1998 (AT) ..... 2017/98

(51) Int. Cl.[7] ..... D05B 73/12
(52) U.S. Cl. ..... 112/260; 112/165
(58) Field of Search ..... 112/260, 163, 112/165, 167, 197

(56) References Cited

U.S. PATENT DOCUMENTS 5,503,094 * 4/1996 Tseng ..... 112/260
5,848,572 * 12/1998 Ito ..... 112/260 X

* cited by examiner

*Primary Examiner*—Peter Nerbun
(74) *Attorney, Agent, or Firm*—Collard & Roe, PC

(57) ABSTRACT

A needle plate for a two-needle interlock sewing machine for sewing a chain stitch seam of three threads, comprising two needle holes and one stitch tongue originating between the two needle holes and extending forward in a feed direction, thereby leaving open thread guiding slots along opposite sides thereof, characterized in that the thread guiding slots are covered in a needle stitching direction by marginal steps on the side of the needle plate except for thread outlet gaps open towards the bottom surface of the stitch tongue, where preferably the marginal steps form a support for the material to be sewn at their upper surface, each marginal step having a take-up ramp in the area of the thread guiding slots subsequent to the needle holes.

2 Claims, 2 Drawing Sheets

NEEDLE PLATE FOR A TWO NEEDLE INTERLOCK SEWING MACHINE

FIELD OF THE INVENTION

This invention relates to a needle plate for a two-needle interlock sewing machine for sewing a chain stitch seam of three threads, comprising two needle holes and one stitch tongue each originating between two needle holes and extending forward in a feed direction thereby leaving open thread-guiding slots along opposite sides thereof.

DESCRIPTION OF THE PRIOR ART

By means of these interlock sewing machines the stitch types 406 and 407 according to DIN 61400 can for instance be produced from three or four threads, where each lower looper thread is interlocked with two upper needle threads to form a chain stitch seam, which is used for seaming, edge sewing or the like of the material to be sewn. During the sewing operation, the needles stitch through the needle holes of the needle plate and pass the needle threads as loops through the material to be sewn, through which loops a loop of the looper thread is then guided at the bottom surface of the needle plate, so that interlocking is effected, which interlocks are drawn against the material to be sewn. The resulting thread loops lay themselves around the stitch tongue, and while the material to be sewn is advanced, they are withdrawn from the stitch tongue, where the thread guiding slots between stitch tongue and actual needle plate provide for the formation of loops and the sliding of the loops off the stitch tongue. During the sewing operation, the thread tension causes the loops to contract while they slide off the stitch tongue, so that above all in the case of soft fabrics the fabric areas lying above the guiding slots may be drawn into the guiding slots or folded seam edges or the like may be detached, so that the formation of the seam maybe impaired by such bulging in or detachment of parts of the material to be sewn.

SUMMARY OF THE INVENTION

It is therefore the object of the invention to create a needle plate as described above, which in a simple way ensures a perfect sewing of very soft material to be sewn.

This object is solved by the invention in that the thread guiding slots are covered in needle stitching direction by marginal steps on the side of the needle plate except for thread outlet gaps open towards the bottom surface of the stitch tongue, where preferably the marginal steps, which on their upper surface form a support for the material to be sewn, have a take-up ramp in the area of the thread guiding slots subsequent to the needle holes.

Therefore, the marginal steps largely close the thread guiding slots in needle stitching direction and with their upper surface provide a support for the material to be sewn, so that during the sewing operation the material to be sewn is supported against the occurring downward pulling forces, and during the formation of the seam no irregularities as a result of folding or bulging or edge detachments of the material to be sewn can occur. The remaining needle outlet gap provides the required clearance for withdrawing the thread loops from the stitch tongue, so that an exact, troublefree sewing operation is ensured. To ensure that above all at the beginning of the sewing operation the material to be sewn can slide onto the marginal edges unimpededly, the same have a corresponding take-up ramp in the area of the guiding slots subsequent to the needle holes, which prevents the material to be sewn from getting caught at the marginal step.

Advantageously, the marginal steps have been prefabricated as separate step inserts and can be inserted into the thread guiding slots from below, so that a relatively simple needle plate fabrication is obtained and it is also possible to subsequently equip the needle plates with corresponding marginal steps.

BRIEF DESCRIPTION OF THE DRAWINGS

In the drawing, the subject-matter of the invention is illustrated by way of example, wherein.

DESCRIPTION OF THE PREFERRED EMBODIMENT

Figure 2:
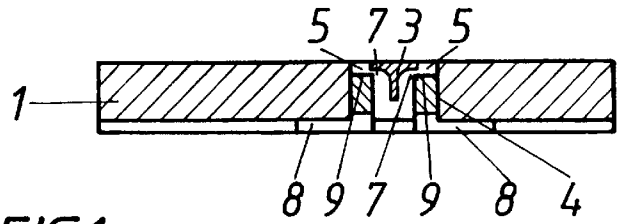
FIG. 2 shows a cross-section along line II—II of FIG. 1.
Figure 1:
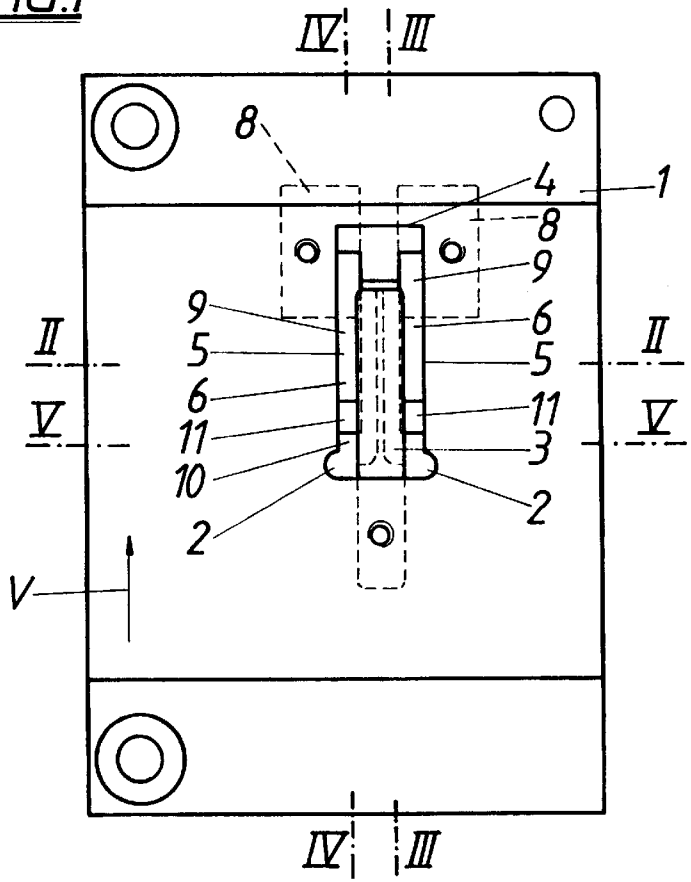
FIG. 1 shows an inventive needle plate in a top view.
Figure 3:
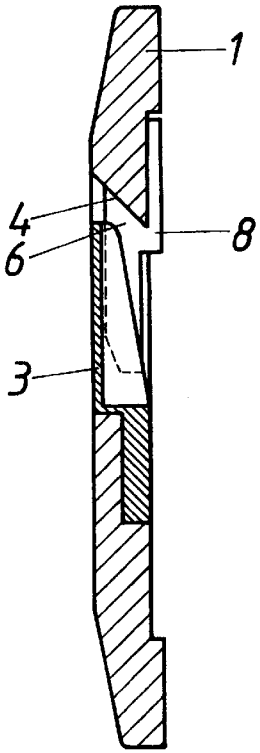
FIGS. 3 and 4 show longitudinal sections along lines III—III and IV—IV of FIG. 1.
Figure 4:
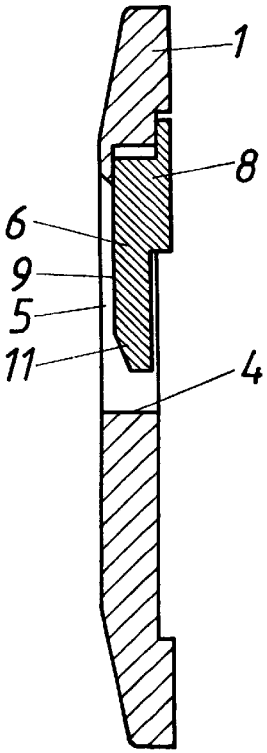

A needle plate 1 for a two-needle interlock sewing machine not represented in detail for sewing a chain stitch seam has two needle holes 2 and a stitch tongue 3 originating between the needle holes 2 and extending forward in feed direction V, where the stitch tongue 3 constitutes a separate insert and has been inserted in a recess 4 of the needle plate, so that alongside the stitch tongue 3 thread guiding slots 5 are obtained.

The thread guiding slots 5 are covered in needle stitching direction by marginal steps 6 on the side of the needle plate except for thread outlet gaps 7 open toward the bottom surface of the stitch tongue, which marginal steps have been prefabricated as separate step inserts 8 and have been fitted into the thread guiding slots 5 from below. At their upper surface, the marginal steps 6 form a support 9 for the material to be sewn, which in the area 10 of the thread guiding slots 5 subsequent to the needle holes 2 verge into a take-up ramp 11.

Figure 5:
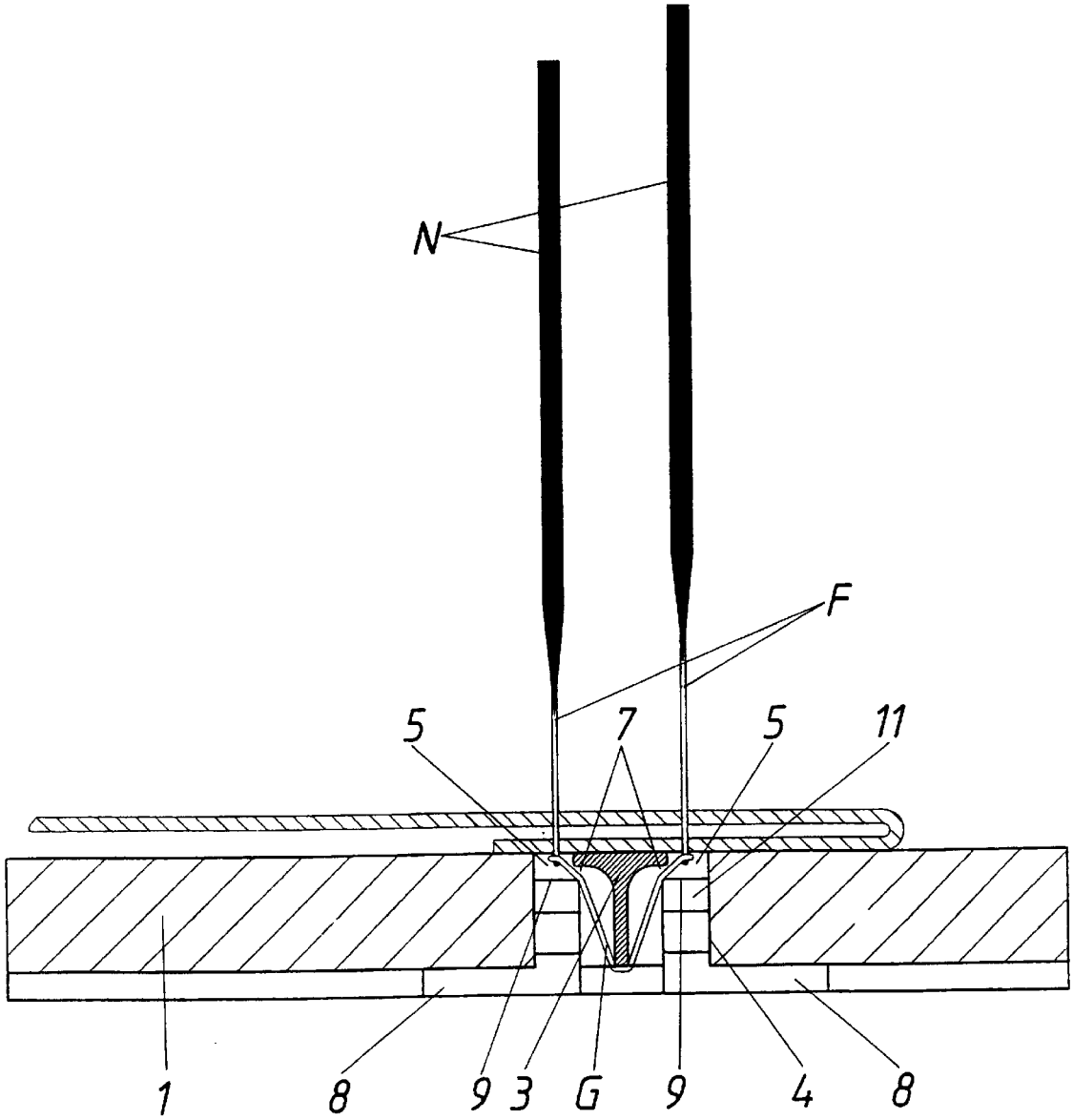
FIG. 5 shows a functional diagram of the needle plate with reference to a cross-section along line V—V of FIG. 1 on an enlarged scale.

As is schematically indicated in FIG. 5, the simple measure of the marginal steps 6 provides a support for the material N to be sewn in the vicinity of the thread guiding slots 5, which above all prevents soft material to be sewn from being drawn into the slots. When sewing with the two needles N, the two upper needle threads F are interlocked with a lower looper thread G to form a chain stitch seam, where the interlocks are drawn against the material to be sewn and as a result downwardly directed tensile forces act on the material to be sewn. The marginal steps 6, however, prevent the formation of major bulgings or marginal detachments or the like and the sewing of a perfect chain stitch seam is ensured.

What is claimed is:

1. A needle plate for a two-needle interlock sewing machine for sewing a chain stitch seam of three threads, comprising two needle holes and one stitch tongue originating between the two needle holes and extending forward in a feed direction thereby leaving open thread guiding slots along opposite sides thereof, characterized in that the thread guiding slots are covered in a needle stitching direction by marginal steps on the side of the needle plate except for thread outlet gaps open towards the bottom surface of the stitch tongue, where preferably the marginal steps form a support for the material to be sewn at their upper surface, each marginal step having a take-up ramp in the area of the thread guiding slots subsequent to the needle holes.

2. The needle plate as claimed in claim 1, characterized in that the marginal steps have been prefabricated as separate step inserts and can be inserted into the thread guiding slots from below.

* * * * *